US006484731B1

(12) United States Patent
Lacout

(10) Patent No.: US 6,484,731 B1
(45) Date of Patent: Nov. 26, 2002

(54) SINGLE-PIECE ARTICULATED ASSEMBLY

(75) Inventor: Frank Lacout, Draveil (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/521,118

(22) Filed: Mar. 7, 2000

(30) Foreign Application Priority Data

Mar. 16, 1999 (FR) ..... 99 03219

(51) Int. Cl.[7] ..... A45D 33/00; A45D 33/24; A45D 33/22

(52) U.S. Cl. ..... 132/293; 132/295; 132/294

(58) Field of Search ..... 132/293, 294, 132/295, 296; 16/150; 220/334; 222/498, 517, 543

(56) References Cited

U.S. PATENT DOCUMENTS

| | | | | | |
|---|---|---|---|---|---|
| 2,195,593 | A | * | 4/1940 | Kreisler | 222/517 |
| 2,467,545 | A | | 4/1949 | Young | 206/45.28 |
| 2,490,746 | A | | 12/1949 | Carpenter, Jr. | 220/32 |
| 2,638,253 | A | * | 5/1953 | Mueller | 222/517 |
| 2,742,665 | A | | 4/1956 | Stopek | 16/128 |
| 3,289,877 | A | * | 12/1966 | Wolf | 222/498 |
| 3,362,591 | A | * | 1/1968 | Latham et al. | 222/498 |
| 3,442,415 | A | | 5/1969 | Glass | 220/32 |
| 3,477,091 | A | | 11/1969 | Gordon | 16/180 |
| 3,541,730 | A | | 11/1970 | Ballantyne | 49/386 |
| 3,741,447 | A | * | 6/1973 | Miles et al. | 222/517 |
| 3,923,180 | A | * | 12/1975 | Fields | 215/216 |
| 3,968,880 | A | * | 7/1976 | Ostrowsky | 206/540 |
| 4,043,480 | A | | 8/1977 | Savoy | 220/334 |
| 4,158,902 | A | | 6/1979 | Chernack et al. | 16/150 |
| 4,401,229 | A | | 8/1983 | Bell et al. | 220/259 |
| 4,452,373 | A | | 6/1984 | Pearce et al. | 220/335 |
| 5,040,680 | A | | 8/1991 | Wilson et al. | 206/459 |
| 5,501,348 | A | | 3/1996 | Takeuchi | 215/235 |

FOREIGN PATENT DOCUMENTS

| | | |
|---|---|---|
| EP | 0 699 591 | 3/1996 |
| EP | 0 727 361 | 8/1996 |
| EP | 0 873 944 | 10/1998 |
| FR | 2 599 715 | 12/1987 |

* cited by examiner

*Primary Examiner*—John J. Wilson
*Assistant Examiner*—Robyn Kieu Doan
(74) *Attorney, Agent, or Firm*—Oblon, Spivak, McClelland, Maier & Neustadt, P.C.

(57) ABSTRACT

A one piece molded assembly including a first part and a second part integral with the first part. The first part includes a first member engageable with a second member formed by the second part so as to form an articulation of the first part and the second part about an axis. Two linking strips are connected to the first and second parts to provide a spring-effect assist for opening and closing of the assembly about the axis, the linking strips crossing the axis in an intermediate position between an open position and a closed position of the assembly.

30 Claims, 2 Drawing Sheets

1
2
3
4
5
6
7
8
9
10
11
12
13
20
21
22
23
24
25
26
30

SINGLE-PIECE ARTICULATED ASSEMBLY

BACKGROUND OF THE INVENTION

Field of the Invention

The present invention relates to an assembly of two parts which are articulated to each other by a hinge of the type with assisted opening/closing, also known as a snap action type hinge. An assembly of this type may, in particular, be formed from a closure element of the type comprising a body on which a closure cap is articulated. Alternatively, it may be a container of the type comprising a lid articulated to a base. A container of this type may have the form of a case of the make-up-case type, or a pot, or any other form of container capable of being closed by an articulated lid.

Particularly as regards closure elements, it is known to produce such elements in two unitarily molded polyethylene or polypropylene parts. The two parts can be folded about an axis and joined by film hinges with at least one intermediate element arranged between them. The intermediate element is capable of forming a spring in order, after an unstable balance position has been passed, to bias the cap of the closure element into the closed or substantially closed or open position. With a configuration of this type, the axis of articulation is defined by the film hinge which may break after having been handled a number of times. Accordingly, a structure of this type is not the most appropriate for articulating the lid of a case to its base, particularly for reasons of strength and appearance. The same applies to articulating a lid to a pot or another container of the same type.

EP-B-699,591 shows a structure in which the spring function is provided by a member of a lid which, during assembly, is positioned in a corresponding housing of the base to which the lid is articulated. The articulation axis is defined by conventional film hinges. Moreover, with this type of design only opening is assisted. Upon closure, the member forming the spring exerts a return force opposed to the closure movement.

It is known, particularly from U.S. Pat. No. 4,158,902, to provide tabs on a lid, which tabs form a spring and are capable of interacting with members of the same type carried by a base to which the lid is articulated. The articulation axis about which the lid pivots is formed from one or more film hinges.

U.S. Pat. No. 4,124,151 describes a bottle cap of the type comprising a body intended to be mounted on a container and a cap capable of reversibly closing an orifice in the body of the cap. In an intermediate position between the open position and the closed position, the distance between two ends of an elastic linking strip passes a minimum value, the linking strip in this position being compressed so as to form a spring. A configuration of this type is perceived by consumers to be awkward to open and to close. Moreover, it is relatively weak.

SUMMARY OF THE INVENTION

It is one object of the present invention to produce an assembly of two parts which are articulated to each other, totally or partially solving the problems mentioned above.

It is a further object of the present invention to produce an assembly, articulated by a spring-effect hinge, which is reliable and economical to produce.

According to the invention, the above and other objects are achieved by a molded one piece assembly, including a first part, and a second part articulated to the first part by a spring-effect hinge. At least one linking strip provides assisted opening and closing of the assembly about a fixed articulation axis (A). The first part forms at least one member capable, after molding, of being placed in engagement with at least one corresponding member formed by the second part so as to form at least one articulation zone about the axis (A), the linking strip or strips being capable, in an intermediate position between an open position and a closed position of the assembly, of crossing the axis (A).

There is thus produced an articulated assembly of which the opening and closing are assisted. The assembly thus produced offers all the advantages of structures articulated as a single piece, particularly in terms of manufacturing cost. Moreover, the axis of articulation has, in terms of robustness and appearance, characteristics which are similar to those of articulations of the attached-pin type. The ease of use afforded by a structure in which the linking strip intersects the axis is generally judged to be more satisfactory than that afforded by a structure of the type described in the above mentioned U.S. Pat. No. 4,124,151.

According to an advantageous characteristic of the invention, the linking strip comprises a first end integral with the first part and a second end integral with the second part, the distance between the first and second ends passing a maximum value in the intermediate position. Thus, in the closed position of the assembly, the linking strip intersects a closure plane (PF). By passing through the intermediate position, it is subject to maximum tension. After passing through the intermediate position, according to a relative movement of the first and second parts in a first direction, the linking strip elastically returns the second part into the closed or substantially closed position. After passing through the intermediate position, in a direction which is opposite from the first, the linking strip elastically returns the second part to the open position.

According to a particular embodiment, the assembly according to the invention comprises a linking strip positioned between two articulation zones defining the axis (A). According to an alternative, the assembly comprises two linking strips separated by an articulation zone defining the axis (A).

Preferably, the member formed by the first part consists of a pin, and the member formed by the second part consists of a housing oriented parallel to the pin and intended to receive the pin via an opening oriented parallel to the pin, or vice versa.

The opening of the housing or housings is delimited by two edges and advantageously extends over an angle such that the pin elastically deforms the edges upon snap-fitting of the pin in the housing. In this way, the risk of the pin becoming detached from its housing is substantially reduced.

The piece may be formed from a single thermoplastic material, for example a polyethylene or a polypropylene. Alternatively, it may, for example, be produced by dual injection and is formed from at least two physically/chemically compatible materials, i.e., materials that are capable, in the molten state, of together forming physical/chemical bonds. By way of example, it may be formed from a first thermoplastic material forming the linking strip or strips and from a second thermoplastic material forming the remainder of the piece. Thus, the linking strips are formed by a first material having the necessary elasticity characteristics for their proper functioning while the remainder of the assembly has the characteristics, particularly of hardness or of shine, which are necessary for the appearance sought. A configuration of this type is particularly suitable if the assembly is to form a case, particularly a make-up case.

The first material may, in particular, be an elastomer (particularly a thermoplastic elastomer of the SANTOPRENE® OR KRATON® type), it being possible for the second material to be, for example, a polypropylene or a polyethylene.

According to a first embodiment, the assembly according to the invention forms a closure element, the first part forming a body intended to be mounted (in particular by snap-fitting or screwing) on a container, the body delimiting at least one exit passage in communication with an opening of the container, the second part being formed by a cap capable of temporarily closing the exit passage.

According to a second embodiment, the assembly consists of a container, the first part constituting a receptacle delimiting at least one compartment capable of containing a product, the second part forming a lid capable of covering the at least one compartment. Advantageously, the container allows reversible locking of the lid on the receptacle in the closed position.

Preferably, the container is in the form of a substantially flat case, the base of which delimits at least one compartment for receiving a product, particularly in solid or pulverulent form. A product of this type may, for example, be a make-up product.

BRIEF DESCRIPTION OF THE DRAWINGS

Apart from the arrangements set forth hereinabove, the invention consists of a number of other arrangements which will be explained hereinbelow by way of non-limiting illustrative embodiments which are described with reference to the appended Figures, in which.

DETAILED DESCRIPTION OF THE PREFERRED EMBODIMENT

Figure 1A:
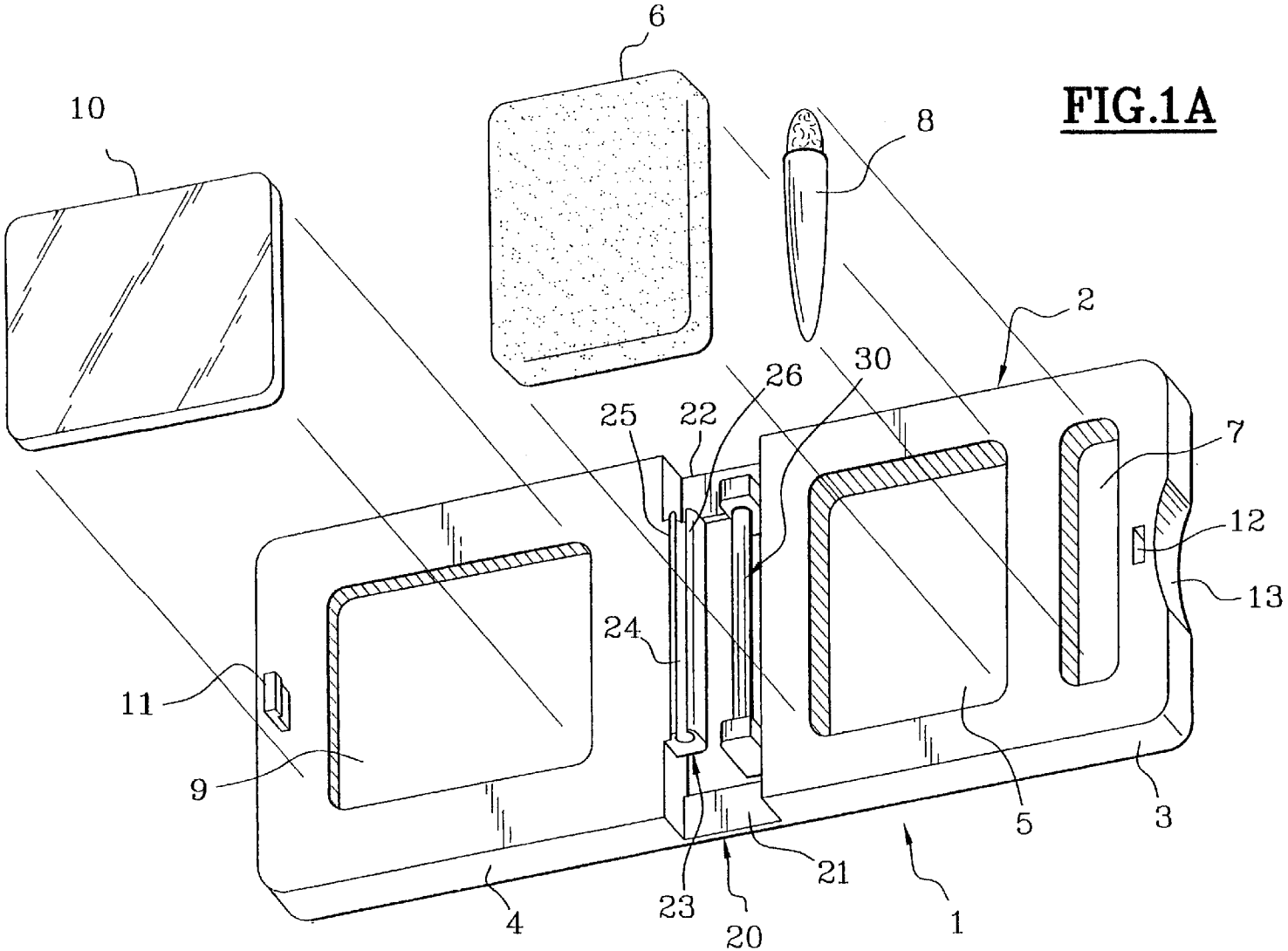
FIG. 1A is an exploded view of an assembly according to the invention consisting of a case of the make-up-case type.

In the exploded view of FIG. 1A, the assembly according to the invention has the form of a substantially flat case 1 such as is used, for example, for packaging make-up products such as foundations, eye shadows, blushers or other products of the same type. The case 1 is formed principally from a molded thermoplastic piece 2 comprising a first part acting as base 3 and a second part acting as lid 4. During molding, the base 3 and the lid 4 are arranged at substantially 180° with respect to each other. The base 3 includes a first compartment 5 capable of receiving a cake of cosmetic product 6 and a second compartment 7 capable of receiving an applicator 8. The lid 4 has a recess 9 extending over a substantial part of its surface so as to receive a mirror 10. A clasp 11 carried by the lid 4 is capable of engaging with a corresponding member 12 carried by the base 3 to provide releasable locking of the lid 4 on the base 3. On its edge opposite the hinge, the base 3 forms a circular-arc-shaped indent 13 to facilitate opening of the case 1.

Figure 1B:
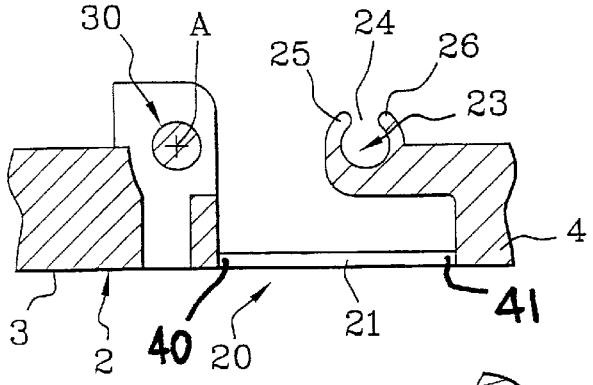
FIG. 1B is a detailed view of the hinge of the assembly shown in FIG. 1A.

The lid 4 is articulated to the base 3 by a hinge 20 of the type with assisted opening and closing. A hinge 20 of this type, shown in greater detail in FIG. 1B, includes two elastically deformable linking strips 21, 22 arranged on each side of the case, each of the linking strips 21, 22 being connected to both the lid 4 at a first end zone 41, and to the base 3 at a second end zone 40. The linking strips 21, 22 are, in the molded position illustrated in FIG. 1A, substantially in a plane which also contains the outer surface of the lid 4 and of the base 3.

Between the two linking strips 21, 22, the lid 4 forms, on its edge adjacent to the base 3, a cylindrical housing 23 which has an opening 24 delimited by two free edges 25, 26 of the housing 23, the opening 24 extending over the entire width of the housing 23. The housing 23 is centered on the edge which carries it and extends over approximately three fourths of the width of the lid 4.

Figure 2A:
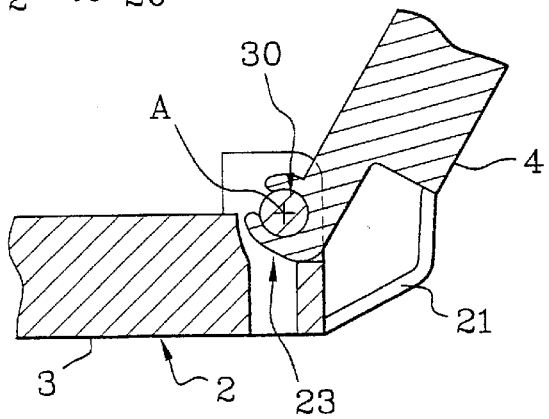
FIGS. 2A–2C illustrate different stages in the closure of the assembly of FIG. 1A, with the hinge in the mounted position.

Between the two linking strips 21, 22, the base 3 forms, on its edge adjacent to the lid 4, a pin 30 whose length and cross section are selected so that, in the assembled position illustrated in FIG. 2A, the pin 30 can be engaged inside the housing 23 via the opening 24, so as to form the articulation of the lid 4 on the base 3 about the axis A. Preferably, the cross section of the pin 30 is selected so that it causes an elastic deformation of the edges 25, 26 which delimit the opening 24 as it enters the housing 23. After the pin 30 enters the housing 23, the edges 25, 26 elastically return to the rest position and close over the pin 30.

In FIG. 2A, the case 1 is shown in the open position, with the lid 4 substantially at 110° with respect to the base 3. In this "assembled" position, the pin 30 is arranged inside the housing 23 so as to define an articulation of the lid 4 to the base 3 about the axis A. Engagement of the pin 30 in the housing 23 can be achieved either upon exit from the mold or later during the process of finishing the case. As appears clearly in this Figure, the linking strips 21, 22 are located on a first side (outside) of the axis of articulation A and are not substantially stretched.

Figure 2B:
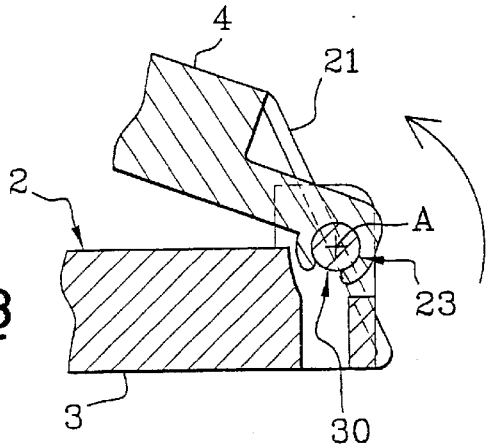

As the lid 4 is closed in the manner shown in FIG. 2B, it passes a position (located at approximately 20° with respect to the plane of the base 3) in which the strips 22 and 22 cross the axis A. In this unstable balance position, the strips 21, 22 are in their maximum-extension. The distance between the ends 40 and 41 of the linking strips 21, 22 is at a maximum. It is possible, simply by altering the configuration of the articulation, to alter the angle of maximum opening of the case and the angle corresponding to the balance position in which the linking strips 21 and 22 are at maximum extension. In particular, the assembly may be configured such that the balance position corresponds to an angle of approximately 45° between the lid 4 and the base 3.

Figure 2C:
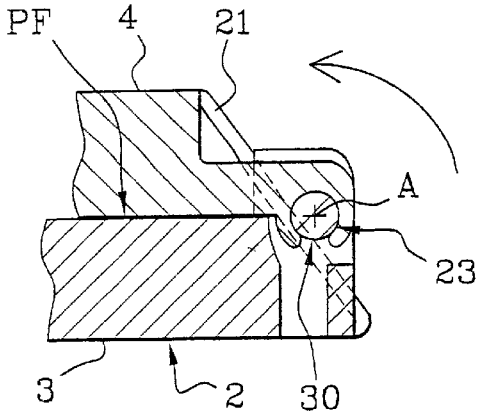

By continuing to close the lid 4 in the direction of the base, the strips 21, 22 cross the axis A and, by their elastic return, pull the lid 4 in the direction of the base 3 so as to bring it either into the closed position (FIG. 2C) or into a semi-closed position. In this position, the linking strips 21, 22 are located on the other side of the axis A (i.e., inside, relative to their position in FIG. 2A) and are not substantially stretched, or at any rate they are stretched to a lesser extent than in their position in FIG. 2B. The lid 4 may be locked on the base 3 by means of pressure exerted on the lid 4. In the closed position illustrated in FIG. 2C, the strips 21, 22 intersect the closure plane PF of the case.

On opening, the kinematics are reversed: after having passed through the maximum-extension position, the linking strips 21, 22 pull the lid into its maximum-opening position with respect to the base.

The arrangement with a pin engaging inside a housing may be replaced by two lateral studs carried by the lid 4 which are capable of engaging inside corresponding housings formed in the base 3 and aligned on the axis of articulation A.

In the preceding detailed description, reference has been made to preferred embodiments of the invention. Obviously, variations may be made thereto without departing from the spirit of the invention as claimed hereinbelow.

What is claimed is:

1. A one piece molded assembly comprising:

a first part;

a second part integral with said first part, said first part including at least one first member engageable with at least one second member formed by the second part so as to form an articulation of said first part and said second part about an axis; and at least one linking strip connected to said first and second parts to provide a spring-effect assist for opening and closing of the assembly about said axis, said linking strip crossing said axis in an intermediate position between an open position and a closed position of the assembly;

wherein said first member comprises a pin, and said second member comprises a housing oriented parallel to said pin and having an opening to receive said pin, and wherein the opening of the housing is delimited by two edges and extends at an angular portion such that the pin elastically snap-fits in the housing.

2. The assembly according to claim 1, wherein the linking strip has a first end integral with the first part and a second end integral with the second part, the distance between said first and second ends having a maximum value in an intermediate position crossing said axis.

3. The assembly according to claim 1, wherein said linking strip is connected between two articulation zones adjacent said axis.

4. The assembly according to claim 3, comprising two of said linking strips.

5. The assembly according to claim 1, formed from one of polyethylene and polypropylene.

6. The assembly according to claim 1, formed from at least two physically/chemically compatible molded materials.

7. The assembly according to claim 6, wherein the linking strip is formed from a first thermoplastic material, and wherein the first and second parts are formed from a second thermoplastic material.

8. The assembly according to claim 7, wherein the first material is a thermoplastic elastomer, and the second material is one of a polypropylene and a polyethylene.

9. A one piece molded assembly comprising:

a first part;

a second part integral with said first part, said first part including at least one first member engageable with at least one second member formed by the second part so as to form an articulation of said first part and said second part about an axis; and at least one linking strip connected to said first and second parts to provide a spring-effect assist for opening and closing of the assembly about said axis, said linking strip crossing said axis in an intermediate position between an open position and a closed position of the assembly;

wherein said first part comprises a body to be mounted on a container, said body delimiting at least one exit passage of said container, said second part comprising a cap capable of temporarily closing said exit passage.

10. A one piece molded assembly comprising:

a first part;

a second part integral with said first part, said first part including at least one first member engageable with at least one second member formed by the second part so as to form an articulation of said first part and said second part about an axis; and at least one linking strip connected to said first and second parts to provide a spring-effect assist for opening and closing of the assembly about said axis, said linking strip crossing said axis in an intermediate position between an open position and a closed position of the assembly;

wherein said first part comprises a receptacle delimiting at least one compartment capable of containing a product, the second part forming a lid capable of covering said compartment.

11. The assembly according to claim 10, further comprising a lock capable of locking the first and second parts in a closed position.

12. The assembly according to claim 10, wherein the receptacle comprises a substantially flat case.

13. A one-piece molded assembly as recited in claim 1, wherein at least one of said first part and said second part contains a cosmetic product.

14. A one-piece molded assembly as recited in claim 10, wherein said at least one compartment contains a cake of a cosmetic product.

15. A one-piece molded assembly as recited in claim 14, wherein another compartment is associated with one of said first part and said second part, and wherein said another compartment contains an applicator.

16. A one-piece molded assembly as recited in claim 10, further including means for locking said assembly in said closed position.

17. A molded assembly comprising:

a first part, said first part including at least one compartment associated therewith, wherein said compartment is capable of containing a product, said first part further including at least one first member associated therewith;

a second part, said second part including a lid capable of covering said at least one compartment, said second part further including at least one second member associated therewith;

wherein said first member and said second member are engageable to form an articulation of said first part and said second part about an axis;

said assembly further including at least one linking strip connecting said first and second parts to provide a spring-effect to assist in at least one of opening and closing of said assembly about said axis, said linking strip crossing said axis in an intermediate position between an open position and a closed position of the assembly.

18. An assembly as recited in claim 17, wherein said first and second members snap-fit together to form said articulation.

19. An assembly as recited in claim 18, wherein one of said first and second members includes a pin and another of said first and second members includes a housing which receives said pin.

20. An assembly as recited in claim 17, wherein said assembly includes two of said linking strips, and wherein said articulation is disposed between said two linking strips when said linking strips cross said axis.

21. An assembly as recited in claim 17, wherein said at least one linking strip is under tension over at least a portion of movement between said open position and said closed position.

22. An assembly as recited in claim 17, wherein said at least one compartment contains a make-up product.

23. An assembly as recited in claim 17, wherein said first and second parts are formed of a first material and said at least one linking strip is formed of a second material.

24. An assembly as recited in claim 23, wherein said first and second materials are thermoplastic materials.

25. An assembly as recited in claim 23, wherein said first and second parts and said at least one linking strip are formed by injection molding.

26. An assembly as recited in claim 17, wherein said at least one compartment contains a cake of a cosmetic product.

27. An assembly as recited in claim 26, wherein said first part further includes another compartment and wherein said another compartment receives an applicator.

28. An assembly as recited in claim 26, wherein a mirror is associated with said second part.

29. An assembly as recited in claim 17, wherein said first and second parts and said at least one linking strip are molded as a one-piece assembly.

30. An assembly as recited in claim 17, further including a projection associated with one of said first and second parts forming a clasp, and wherein the other of said first and second parts includes a recess which receives said clasp for locking said assembly in said closed position.

* * * * *